US007175307B2

(12) United States Patent
Lee

(10) Patent No.: US 7,175,307 B2
(45) Date of Patent: Feb. 13, 2007

(54) SPLENDID DECORATIVE PLATE

(76) Inventor: Hung-Wen Lee, No. 188, Shien Chang 2nd Road, Chupei City, Hsinchu Shien (TW)

( * ) Notice: Subject to any disclaimer, the term of this patent is extended or adjusted under 35 U.S.C. 154(b) by 0 days.

(21) Appl. No.: 11/171,436

(22) Filed: Jul. 1, 2005

(65) Prior Publication Data

US 2007/0002581 A1 Jan. 4, 2007

(51) Int. Cl.
*F21V 5/00* (2006.01)

(52) U.S. Cl. ..... 362/246; 362/252

(58) Field of Classification Search ..... 362/807, 362/806, 246

See application file for complete search history.

(56) References Cited

U.S. PATENT DOCUMENTS

| | | | | |
|---|---|---|---|---|
| 5,430,629 | A * | 7/1995 | Belliveau et al. | 362/293 |
| 6,863,415 | B2 * | 3/2005 | Lu | 362/101 |
| 2004/0125594 | A1 * | 7/2004 | Wu | 362/101 |
| 2005/0024869 | A1 * | 2/2005 | Chen et al. | 362/235 |

* cited by examiner

*Primary Examiner*—Renee Luebke
*Assistant Examiner*—Julie A. Shallenberger
(74) *Attorney, Agent, or Firm*—Rosenberg, Klein & Lee

(57) ABSTRACT

The invention relates to a splendid decorative board, which includes two transparent plates and a splendid layer provided therebetween. A light source can be mounted on a side of the rear plate to emit its ray through the splendid layer having pattern of concentric shapes to display a splendid lighting effect on the front plate that obtains a beautiful decoration.

2 Claims, 5 Drawing Sheets

SPLENDID DECORATIVE PLATE

FIELD OF THE INVENTION

The present invention relates to a splendid decorative board, which includes two transparent plates and a splendid layer therebetween. As a light source mounted on a side. of a plate, it will emit its ray through the board to display a splendid lighting effect for beautiful decoration.

BACKGROUND OF THE INVENTION

It is known to use a Christmas light string as a lighting decoration for providing twinkling effect. The traditional light source is usually a single lighting spot. The single lighting spot can just provide monotonous ray. Although there are several lighting spots, the decorative effect is still poor.

SUMMARY OF THE INVENTION

The present invention is to provide a splendid decorative board, which mainly includes a splendid layer provided between two transparent plates to show a splendid lighting effect under a single light source. Now, accompanying with the following drawings, the character of the present invention will be described here and after.

DETAILED DESCRIPTION OF THE PREFERRED EMBODIMENT

Figure 1:
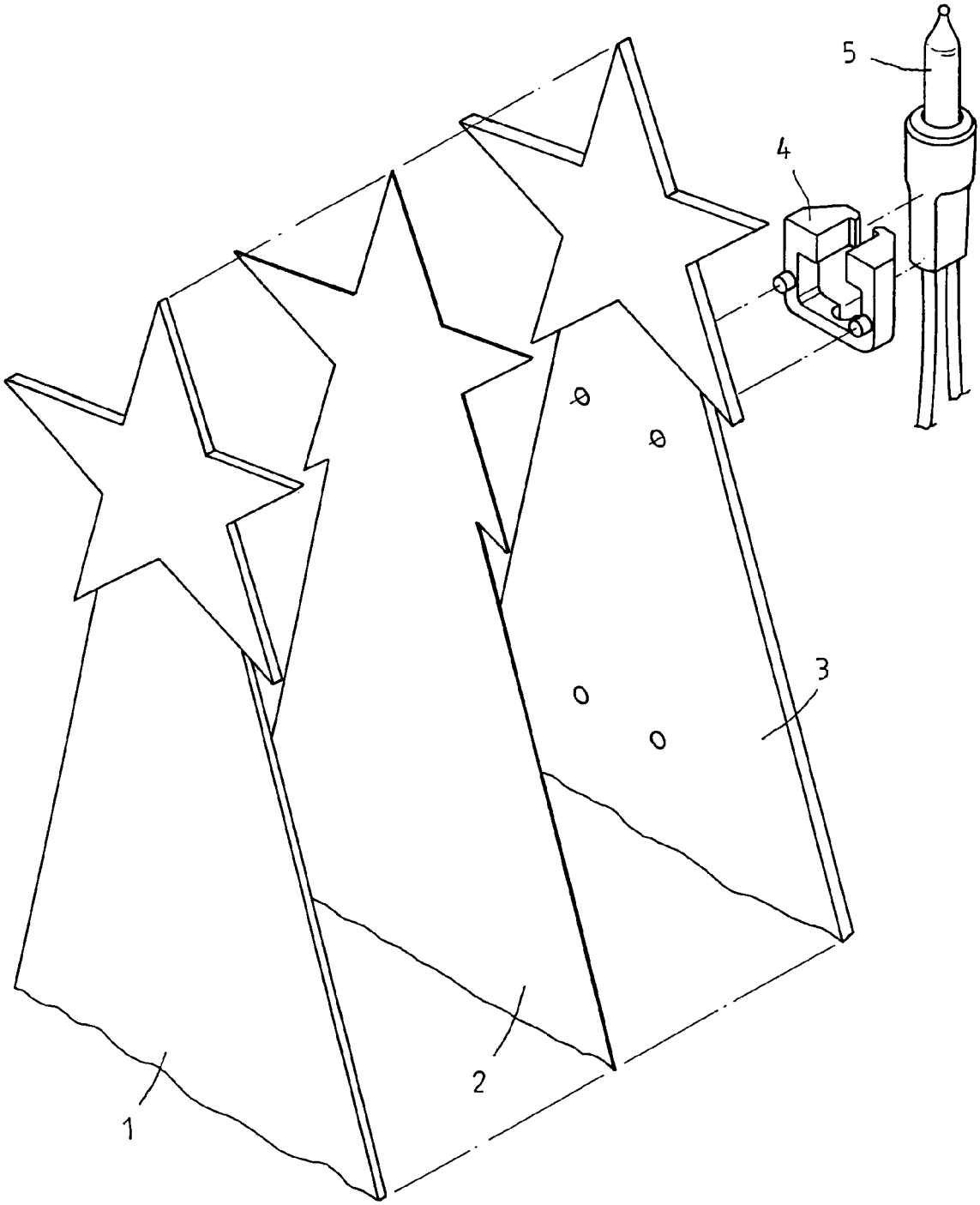
FIG. 1 is an exploded perspective view showing a splendid decorative board according to the present invention.
Figure 2:
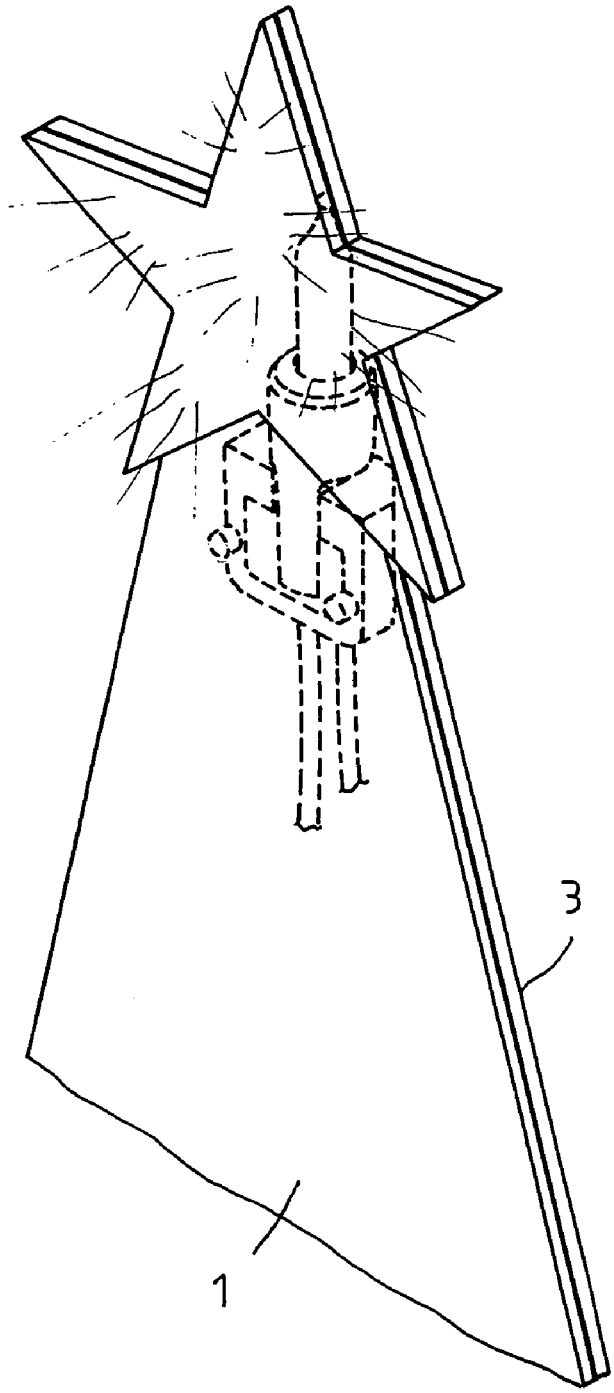
FIG. 2 is an assembled perspective view of FIG. 1.
Figure 3:
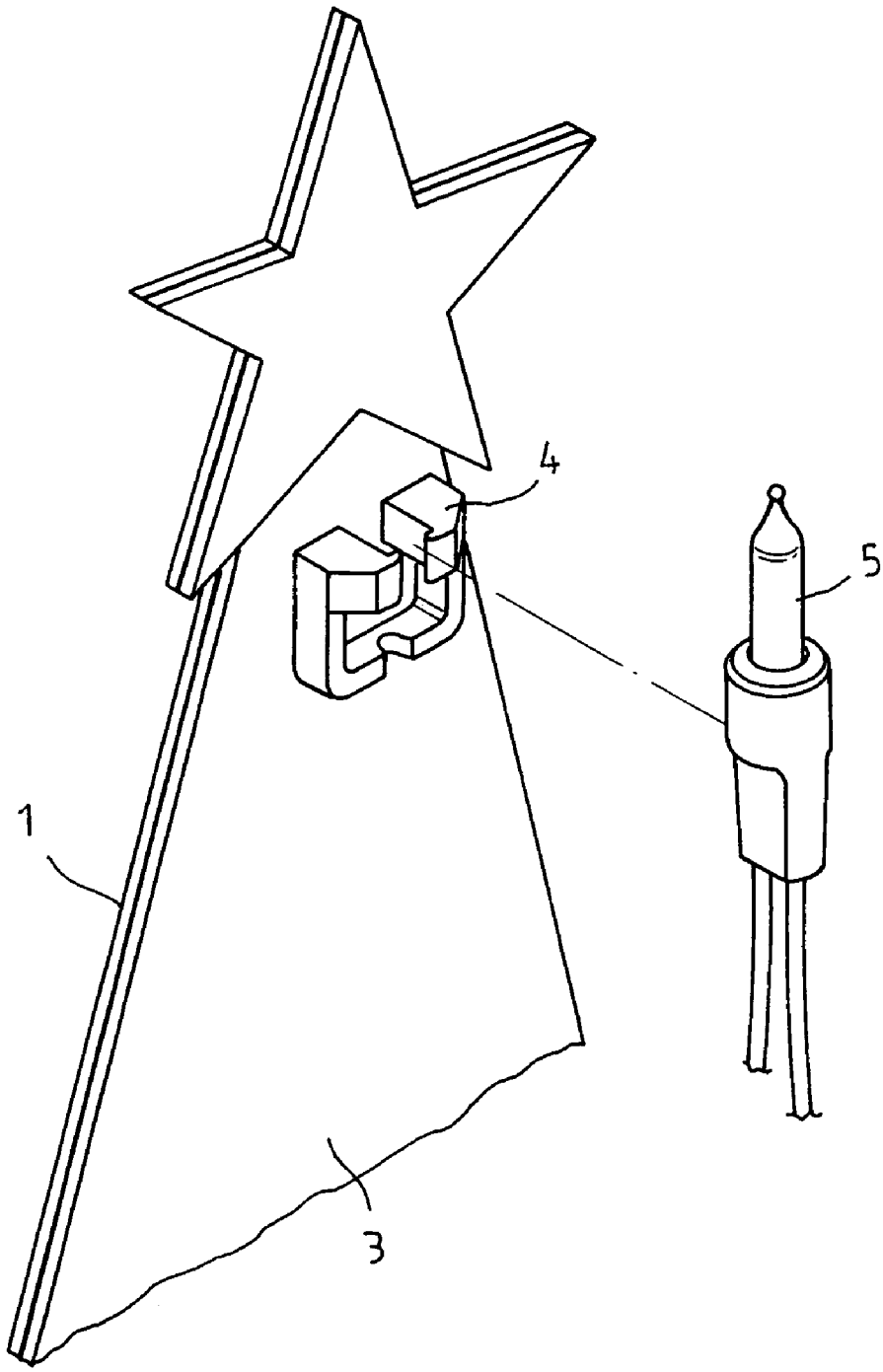
FIG. 3 is another perspective view of FIG. 2.
Figure 4:
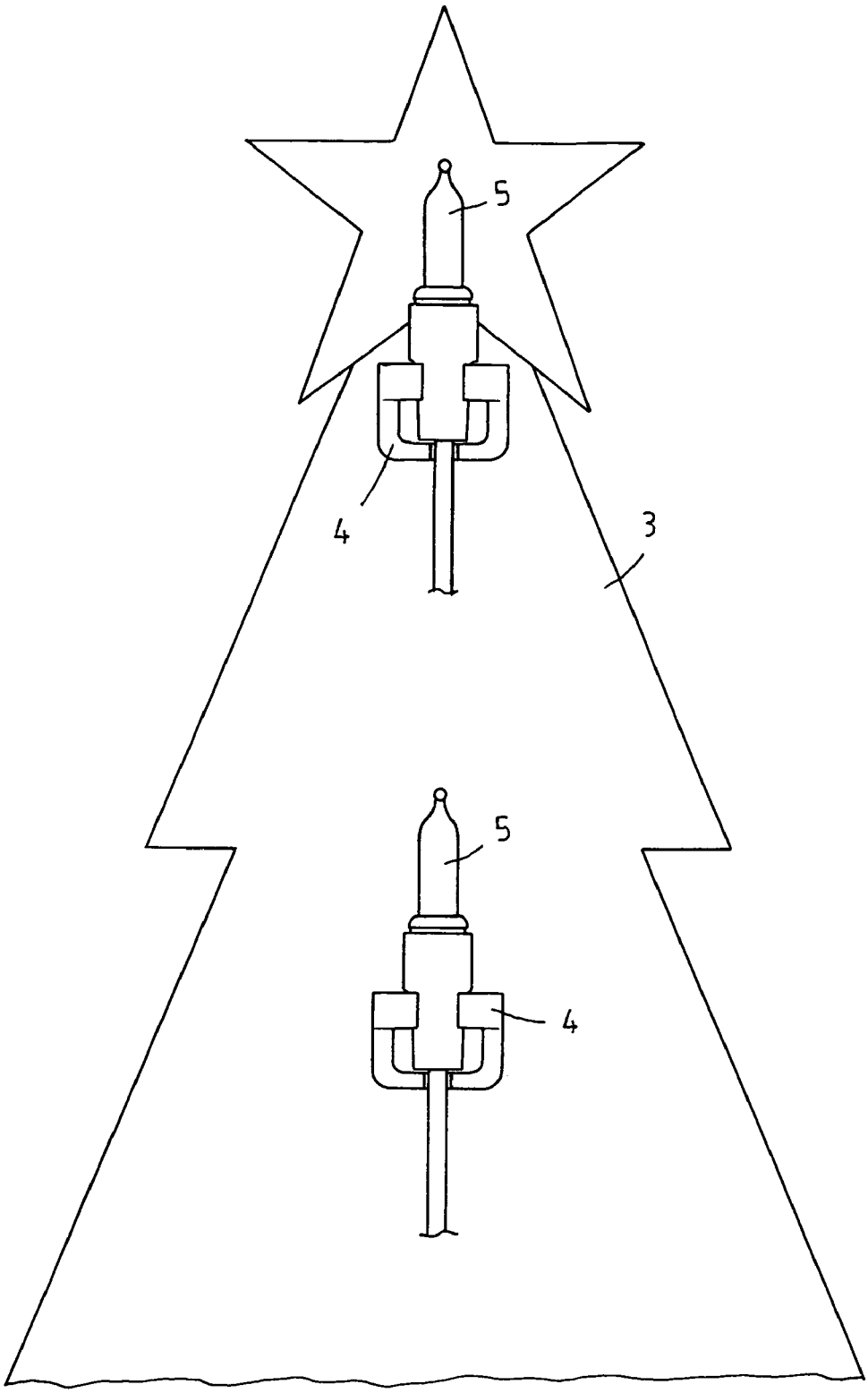
FIG. 4 is a plan view showing rear side of FIG. 2.
Figure 5:
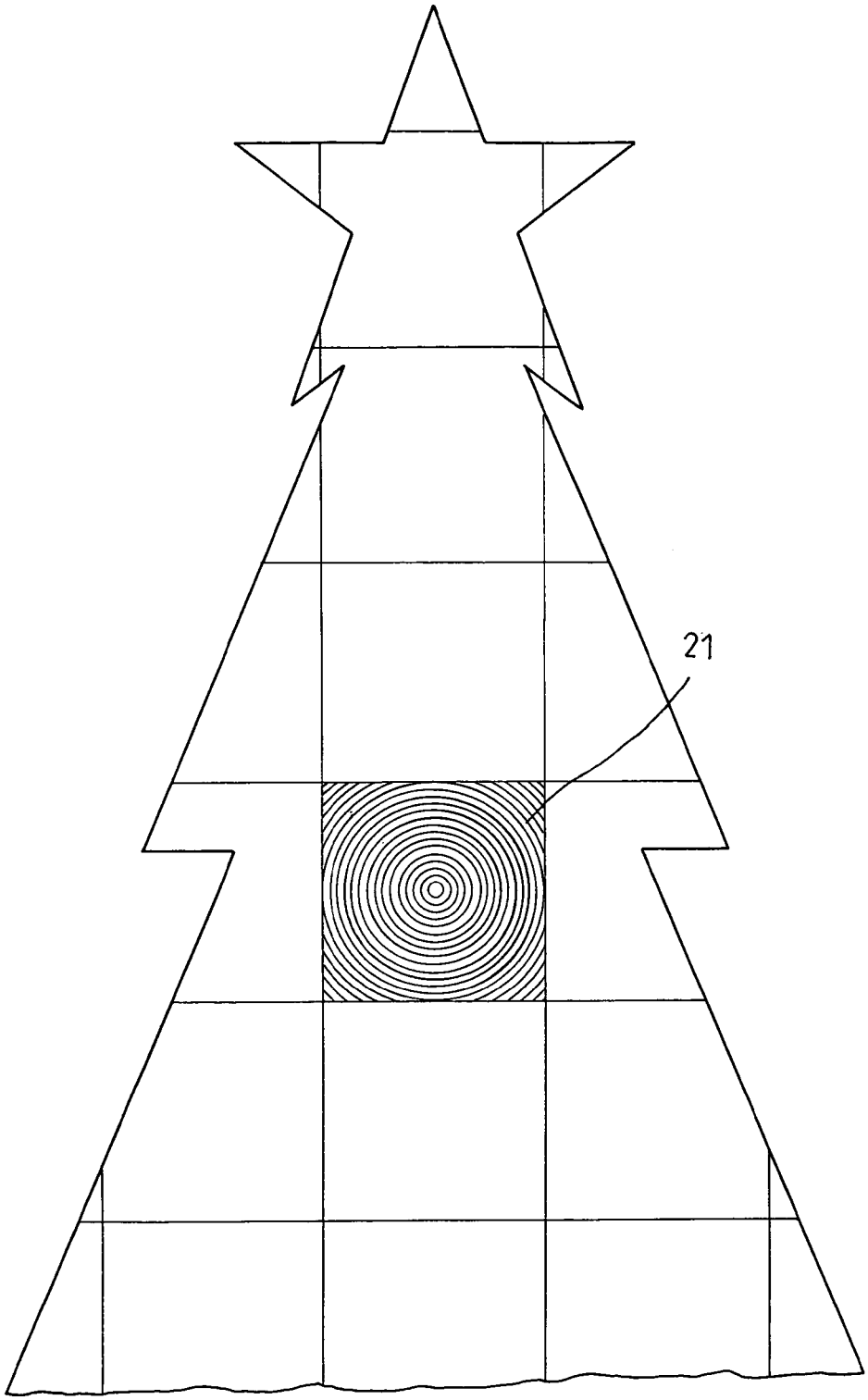
FIG. 5 is a plan view showing an example of the splendid effect from front side when the rear light source is lightened.

Please refer to FIGS. 1 to 3; the present invention relates to a splendid decorative board, which includes a front transparent plate (1), a rear transparent plate (3), and a middle splendid layer (2). The splendid layer (2) has several unit areas, each having a pattern of concentric shapes (21). The rear plate (3) can be provided with a connector (4) for positioning a light source (5) thereon, wherein the light source is illustrated a Christmas bulb assembly in present embodiment. It will be understood that more than one light source (5) can be provided as desired, as shown in FIG. 4.

In use, when the light source (5) emits its ray, the ray passes through the rear plate (3), the splendid layer (2), and the front plate (1). Since the splendid layer (2) has patterns (21), the ray will be disturbed and refracted to display a specific shape on the front plate (1) corresponding to the shape of the patterns on the layer (2). Therefore, the present invention provides a splendid decorative effect under a single light source, which is better than ever.

In above description, it is only an embodiment to illustrate my design and is not to limit the scope of this application. Any modified embodiments with similar merits are also claimed according to the present invention.

I claim:

1. A splendid decorative board including a front transparent plate, a middle light refracting layer, and a rear transparent plate, wherein the middle layer is provided with a plurality of unit areas, each unit area having a multiplicity of light refracting concentric shaped patterns, and the rear plate is provided with at least one connector on an outer surface thereof for positioning a light source thereon to provide illumination through the rear plate, the middle layer and the front plate.

2. The splendid decorative board as claimed in claim 1, wherein the rear plate is provided with a plurality of connectors and corresponding light sources.

* * * * *